US011817664B2

(12) United States Patent
Henrici et al.

(10) Patent No.: US 11,817,664 B2
(45) Date of Patent: Nov. 14, 2023

(54) TERMINAL CLAMP

(71) Applicant: BJB GmbH & Co. KG, Arnsberg (DE)

(72) Inventors: Philipp Henrici, Arnsberg (DE); Olaf Baumeister, Sundern (DE); Markus Nasse, Hamm (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 17/153,092

(22) Filed: Jan. 20, 2021

(65) Prior Publication Data

US 2021/0257751 A1 Aug. 19, 2021

(30) Foreign Application Priority Data

Feb. 19, 2020 (DE) ..... 102020104417.8

(51) Int. Cl.
*H01R 4/48* (2006.01)
*H01R 12/51* (2011.01)

(52) U.S. Cl.
CPC ..... *H01R 4/4827* (2013.01); *H01R 12/515* (2013.01)

(58) Field of Classification Search
None
See application file for complete search history.

(56) References Cited

U.S. PATENT DOCUMENTS 7,507,106 B2 * 3/2009 Keswani ..... H01R 4/4818 439/439
8,328,586 B2 * 12/2012 Bies ..... H01R 4/4836 439/725
8,591,271 B2 * 11/2013 Bies ..... H01R 4/4836 439/852
9,209,530 B2 * 12/2015 Gassauer ..... H01R 4/48
9,472,871 B2 * 10/2016 Lin ..... H01R 12/53
9,570,817 B1 2/2017 Wang et al.
9,799,968 B2 * 10/2017 Lin ..... H01R 12/515

FOREIGN PATENT DOCUMENTS

| | | | |
|---|---|---|---|
| AT | 013705 | U1 | 7/2014 |
| CN | 102237608 | A | 11/2011 |
| CN | 104103914 | A | 10/2014 |
| CN | 1062999805 | A | 1/2017 |
| CN | 110165435 | A | 8/2019 |
| CN | 109690875 | A | 1/2023 |
| DE | 102010014143 | A1 | 10/2011 |
| DE | 202014104939 | U1 | 2/2016 |
| DE | 102015121638 | A1 | 6/2017 |
| EP | 3159974 | A1 | 4/2017 |
| WO | WO2015068907 | A1 | 5/2015 |
| WO | WO2018/041774 | A2 | 3/2018 |

* cited by examiner

*Primary Examiner* — Felix O Figueroa
(74) *Attorney, Agent, or Firm* — Von Rohrscheidt Patents

(57) ABSTRACT

A terminal clamp including a contact frame that forms a clamping device configured to fix and electrically contact a connection conductor, wherein the clamping device is formed by at least one reaction bearing and a clamping spring that is preloaded against the at least one reaction bearing; a conductor insertion channel that feeds the connection conductor to the clamping device; and an insulation material housing made that receives the contact frame and forms a conductor insertion opening that is arranged upstream of the conductor insertion channel in a conductor insertion direction, wherein the conductor insertion channel is formed by the insulation material housing.

3 Claims, 6 Drawing Sheets

TERMINAL CLAMP

RELATED APPLICATIONS

This application claims priority from and incorporates by reference German patent application DE 10 2020 104 417.8 filed on Feb. 19, 2020.

FIELD OF THE INVENTION

The invention relates to a terminal clamp.

BACKGROUND OF THE INVENTION

A generic terminal clamp is disclosed e.g. EP 3 159 974 A1. This terminal clamp is configured to be arranged on a circuit board. Thus, the contact frame forms a contact floor that includes contact bases at a front end that is upstream in conductor insertion direction and a rear end that is downstream in the conductor insertion direction, wherein the contact bases are configured to be soldered to contact fields of the circuit board. The contact frame furthermore includes contact side walls wherein spring elements extend from the contact side walls in the conductor insertion direction. A slanted surface of the metal contact base and a slanted surface that is formed by the insulation material housing of the terminal clamp and arranged opposite to the contact floor are configured to guide the conductor when the conductor is fed through the conductor insertion opening of the insulation material housing to the clamping device.

Terminal clamps are made with very small dimensions typically they have a width that typically does not exceed 3 mm to 4 mm and approximately the same height. A length of 8 mm is rarely exceeded.

Therefore a high level of precision is required in production and assembly in order to position slanted guide surfaces correctly relative to each other that are formed by the insulation material housing on the one hand side and by the metal contact frame on the other hand side.

BRIEF SUMMARY OF THE INVENTION

Thus, it is an object of the invention to provide a conductor guide that is arrangeable more easily wherein the conductor guide feeds an insulation stripped end of a terminal conductor to the clamping device of the contact frame correctly. The object is achieved by A terminal clamp including a contact frame that forms a clamping device configured to fix and electrically contact a connection conductor, wherein the clamping device is formed by at least one reaction bearing and a clamping spring that is preloaded against the at least one reaction bearing; a conductor insertion channel that feeds the connection conductor to the clamping device; and an insulation material housing made that receives the contact frame and forms a conductor insertion opening that is arranged upstream of the conductor insertion channel in a conductor insertion direction, wherein the conductor insertion channel is formed by the insulation material housing.

Thus, it is provided in particular that the conductor insertion channel is formed as a tube that is formed from an insulation material and that extends from a conductor insertion opening towards the clamping device.

The invention omits a conductor support that is influenced by the contact floor of the contact frame. The invention associates conductor guidance exclusively with the insulation material housing that receives the contact frame. A precision association of the various slanted guide surfaces that are known in the art can thus be avoided.

Furthermore it has proven particularly advantageous that the conductor insertion channel that is formed by the insulation material housing is closed on all sides in a longitudinal direction of the contact and only accessible through the conductor insertion opening and releases the guided connection conductor towards the clamping device at an end of the conductor insertion channel through a corresponding outlet opening. Thus, a rather long insertion path of the conductor with respect to the terminal clamp prevents an advance contact between metal portions of the contact frame and the terminal conductor. This has advantages in particular when the terminal clamp is provided with a connection conductor when parts carry a voltage or when electronic components mounted on the circuit board have a residual charge.

In addition to improved conductor guidance operational safety of the terminal clamp is improved substantially.

In order to provide centered guidance for the terminal conductor the conductor insertional channel is tapered funnel shaped from the conductor insertion opening in conductor insertion direction.

Assembly of the contact frame and the insulation material housing can be performed advantageously when the contact frame forms two contact sidewalls that are arranged at the contact floor and receive the conductor insertion channel formed by the insulation material housing between one another.

Contrary to prior art clamps the contact frame is open at least in the receiving portion for the conductor insertion channel formed by the insulation material housing on a side of the contact frame that is opposite to the contact floor, thus the contact frame is open in an upward direction. Therefore the insulation material housing can be placed onto the preassembled contact frame in a simple manner without the conductor insertion channel having to be threaded into an approximately annular closed portion of the contact frame.

It is furthermore provided that the conductor insertion channel forms a guide tongue that is proximal to the contact floor and/or a guide tongue that is remote from the contact floor at an end of the conductor insertion channel that is oriented away from the conductor insertion opening wherein the guide tongue extends in the conductor insertion direction.

The guide tongue that adjoins the insertion channel facilitates a centering support which further improves a centered guidance relative to the contact base or a topside of the terminal clamp.

Thus, it is provided in particular that a clamping spring that extends in the conductor insertion direction from each contact sidewall wherein free ends of the clamping spring are oriented towards each other and form a clamping device and that the guide tongue of the conductor insertion channel is arranged between the clamping springs.

In this embodiment the guide tongues advantageously provide that guiding the connection contact in a portion of the clamping springs is still possible even between the clamping springs that are oriented towards each other or against each other without impairing a function of the clamping springs.

It is furthermore provided that the insulation material housing forms contact bars for the clamping spring that limit a deflection travel of the contact spring during an opening movement.

This embodiment is particularly advantageous when the insulation material housing includes a recess in a cover wall wherein a spreading tool is insertable through the recess and between the free ends of the clamping springs and wherein contact bars are arranged in side walls of the insulation material housing, the contact bars configured to limit an opening spreading movement of the clamping springs.

The stop bars provide that a deflection movement of the clamping springs that is required with respect to particular components of the terminal clamp, in particular the contact frame is prevented. For example, it can be required to limit a lateral deflection of the contact springs in order to prevent that the contact springs are opened beyond a lateral boundary of the contact floor.

BRIEF DESCRIPTION OF THE DRAWINGS

Further advantages of the invention and a better comprehension thereof can be derived from the subsequent description of an embodiment with reference to drawing figures.

DETAILED DESCRIPTION OF THE INVENTION

Figure 1:
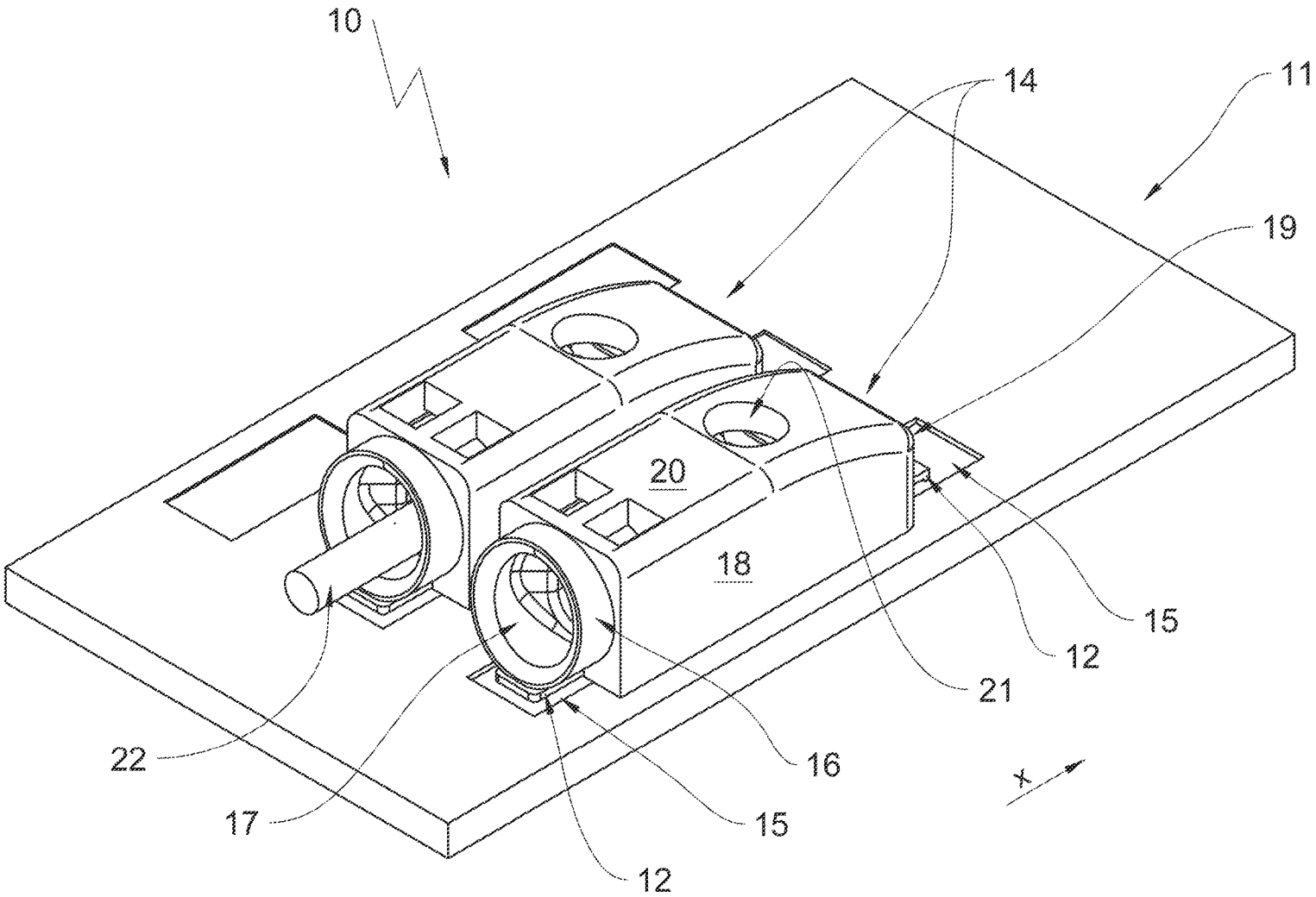
FIG. 1 illustrates an arrangement of two terminal clamps according to the invention on a circuit board.

In the drawing figures a terminal clamp according to the invention is designated overall with reference numeral 10.

In FIG. 1, two terminal clamps 10 according to the invention are placed adjacent to each other on a circuit board 11. The contact bases 12 of a contact frame 13 which is substantially received in an insulation material housing 14 in FIG. 1 sit on contact fields 15 of the circuit board 11 and are electrically connected with the contact fields e.g., through a soldered connection.

The insulation material housing 14 includes in a collar 16 that is arranged upstream in the conductor insertion direction x wherein the collar 16 envelops a conductor insertion opening 17 and covers a forward contact base 12 of the contact frame 13.

The insulation material housing 14 includes two side walls 18 that receive the contact frame 13 between one another, a rear wall 19 that is arranged at an end of the insulation material housing 14 that is arranged opposite to the collar 16 and a cover wall 20.

The cover wall 20 includes a cut out 21 for a tool which will be described in more detail infra.

FIG. 1 illustrates an exemplary connection conductor 22 that is inserted into one of the two terminal clamps illustrated in FIG. 1.

Figure 2:
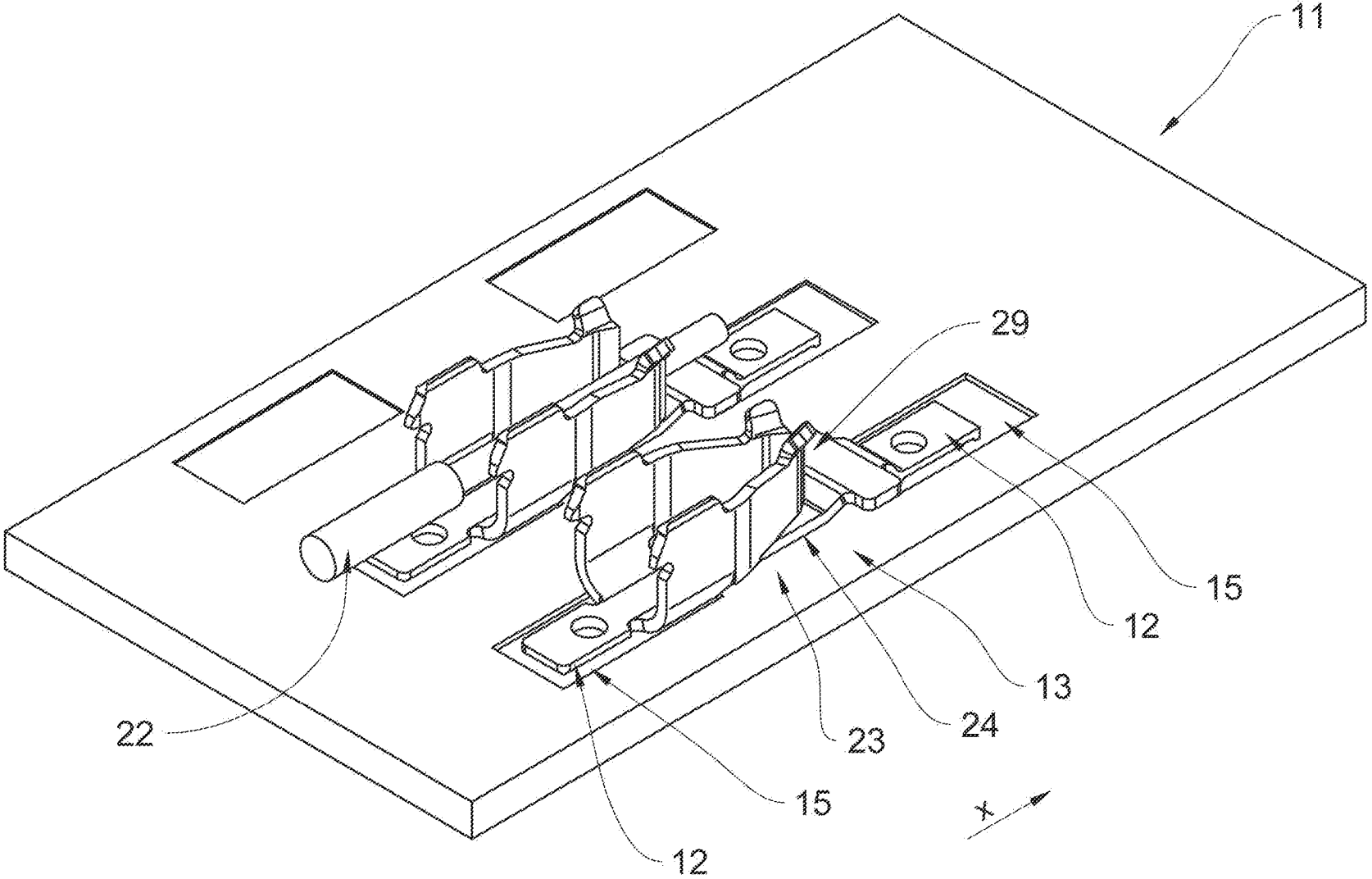
FIG. 2 illustrates the representation according to FIG. 1 without the insulation material housing.

FIG. 2 illustrates the representation according to FIG. 1 without the insulation material housing 14 of the terminal clamps 10. Therefore, only the contact frames 13 are illustrated in FIG. 2 in addition to the circuit board 11 and the connection conductor 22. The contact frames are also illustrated in FIGS. 3 & 4.

Each contact frame 13 includes a contact floor 23 that respectively forms a contact base 12 at ends that are arranged upstream in the conductor insertion direction x and downstream in the conductor insertion direction x wherein the contact bases are configured to be electrically connected with contact fields 15 of the circuit board 11. The contact bases 12 are arranged in a common plane. A bridge section 24 of the contact floor 23 that connects the contact bases 12 is deflected upward relative to a plane of the contact bases 12, thus away from the circuit board 11 and thus offset from the circuit board 11. The bridge section 24 of the contact frame 13 supports two contact sidewalls 25 that form a receiving space 26 between each other wherein the receiving space is open in an upward direction, thus in a direction that faces away from the contact floor 23. A clamping spring 27 extends from each contact sidewall in the conductor insertion direction x wherein free ends of the contact springs are oriented towards each other. Ends of the clamping spring 27 can be preloaded relative to each other or just contact each other or can be offset from each other with a small separation gap.

The clamping springs 27 respectively include a spreading appendix 28 at an edge that is oriented away from the contact floor 23. The spreading appendices 28 are configured to receive a spreading tool between each other in order to spread the clamping springs away from each other while building up spring tension and causing an opening movement that opens a clamping device 29 formed by the clamping springs 27. In this embodiment of this clamping device 29 each clamping spring 27 functions as a reaction bearing for its respective opposing part.

Figure 4:
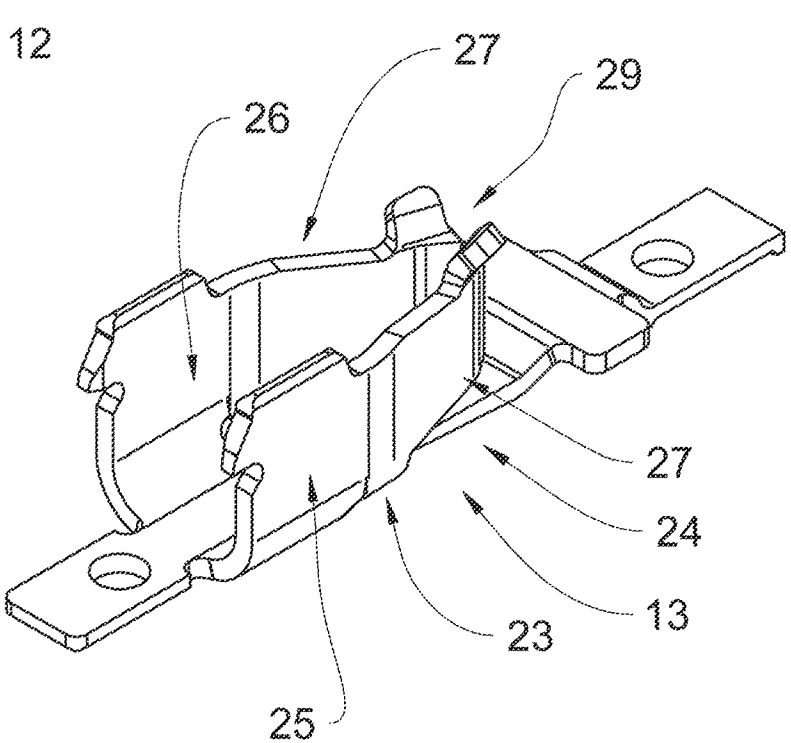
FIG. 4 illustrates a representation according to FIG. 3 without the connection conductor.
Figure 3:
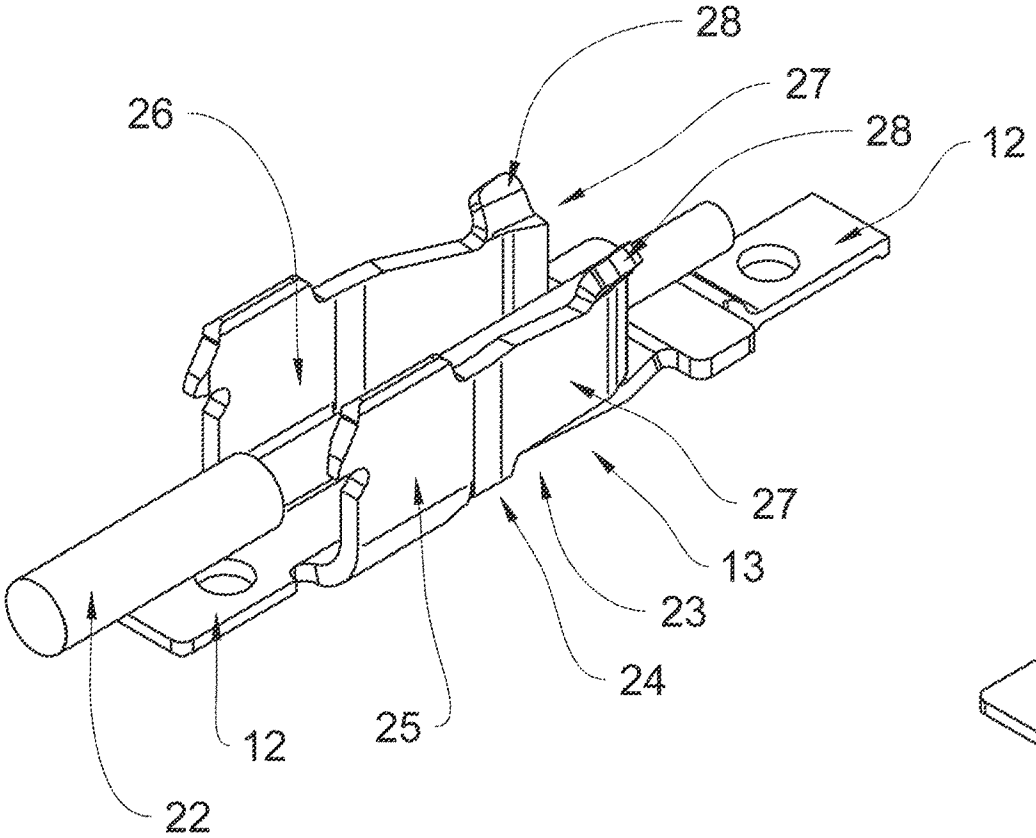
FIG. 3 illustrates a contact frame of a terminal clamp according to the invention with an inserted connection conductor.

As evident from a comparison view of FIGS. 3 and 4 and FIG. 2 an insulation stripped end of the connection conductor 22 is inserted into the terminal clamp 10 in order to provide electrical contacting, wherein the insulation stripped conductor end is inserted into the clamping device 29 and mechanically fixed therein by the clamping springs 27 so that electrical contact is established.

Figure 5:
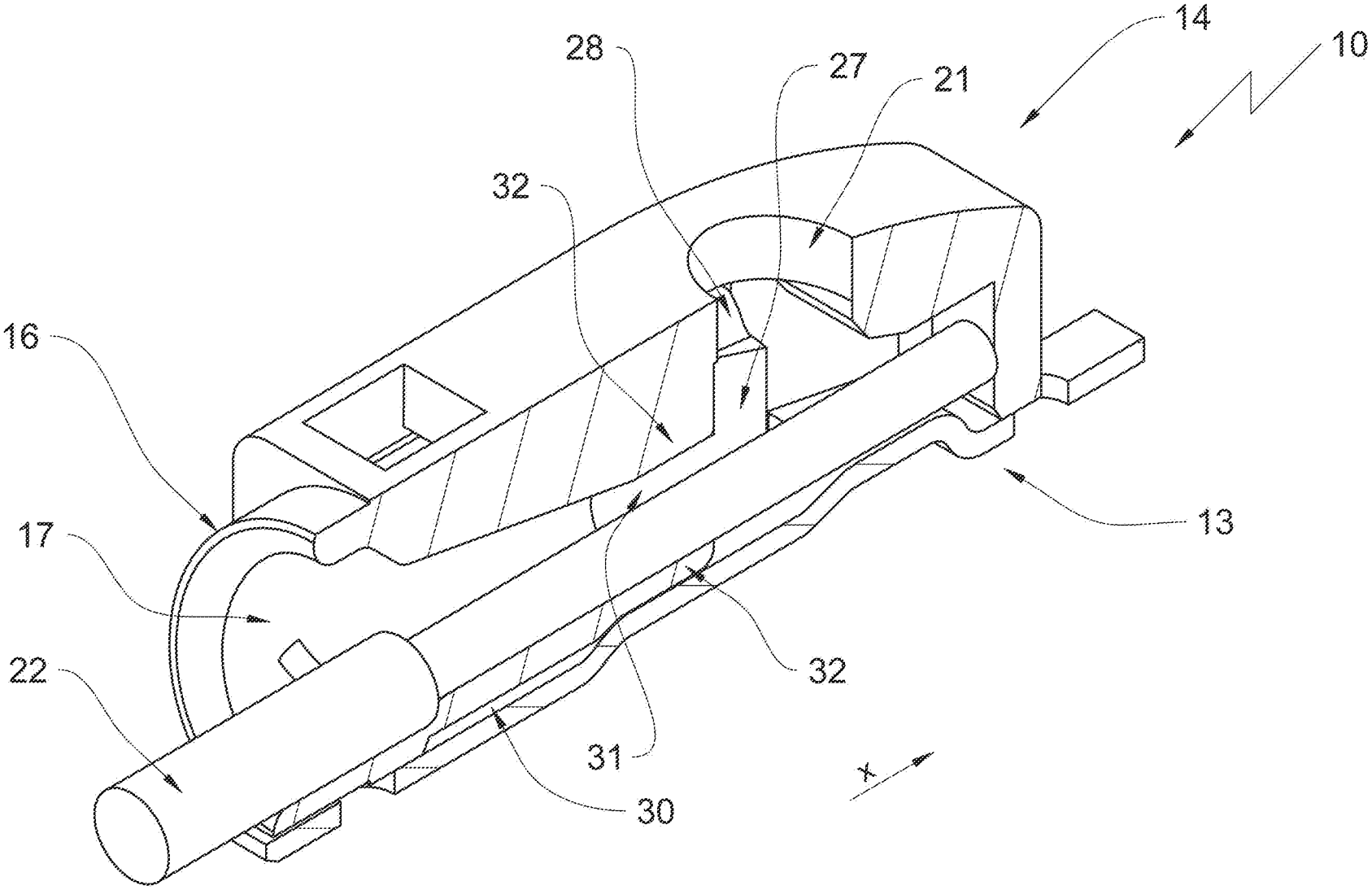
FIG. 5 illustrates a sectional view of a terminal clamp according to the invention along a vertical longitudinal plane in a perspective view.
Figure 6:
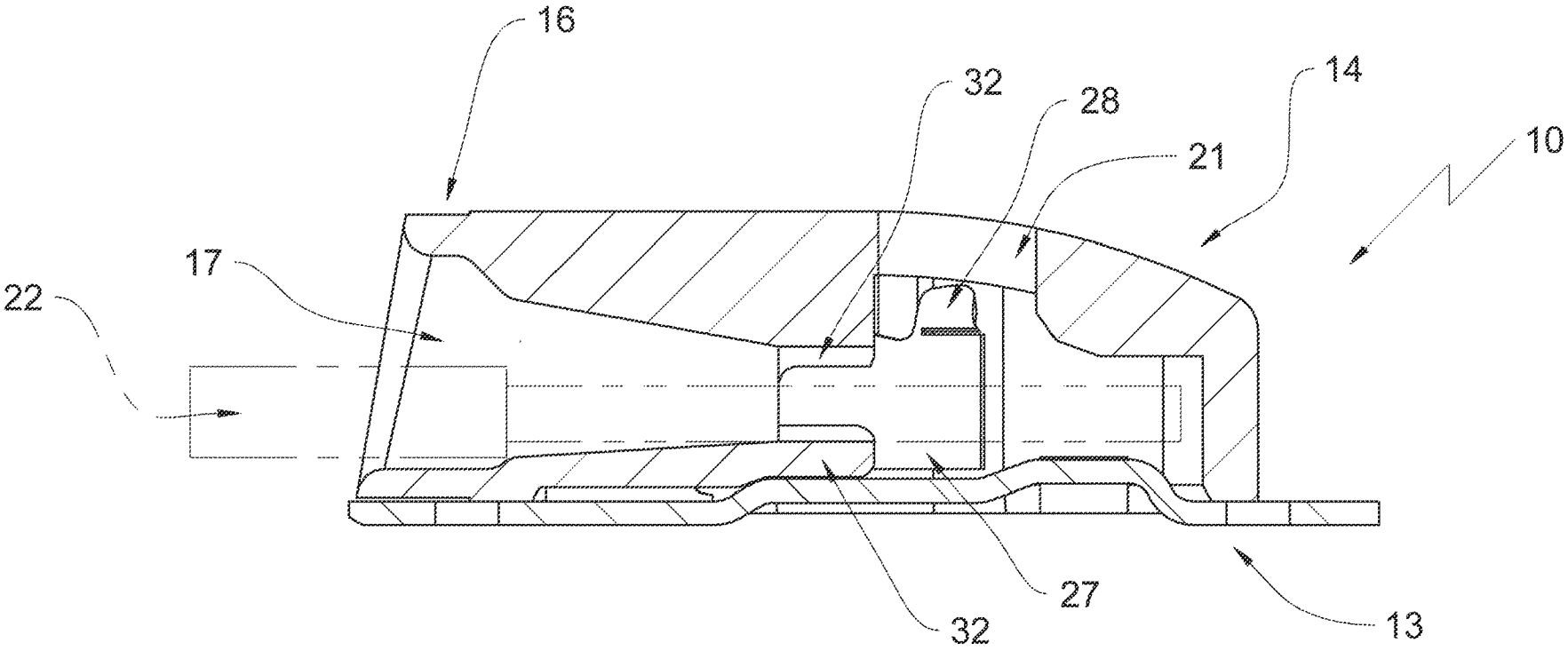
FIG. 6 illustrates the sectional view according to FIG. 5 in a side view.
Figure 7:
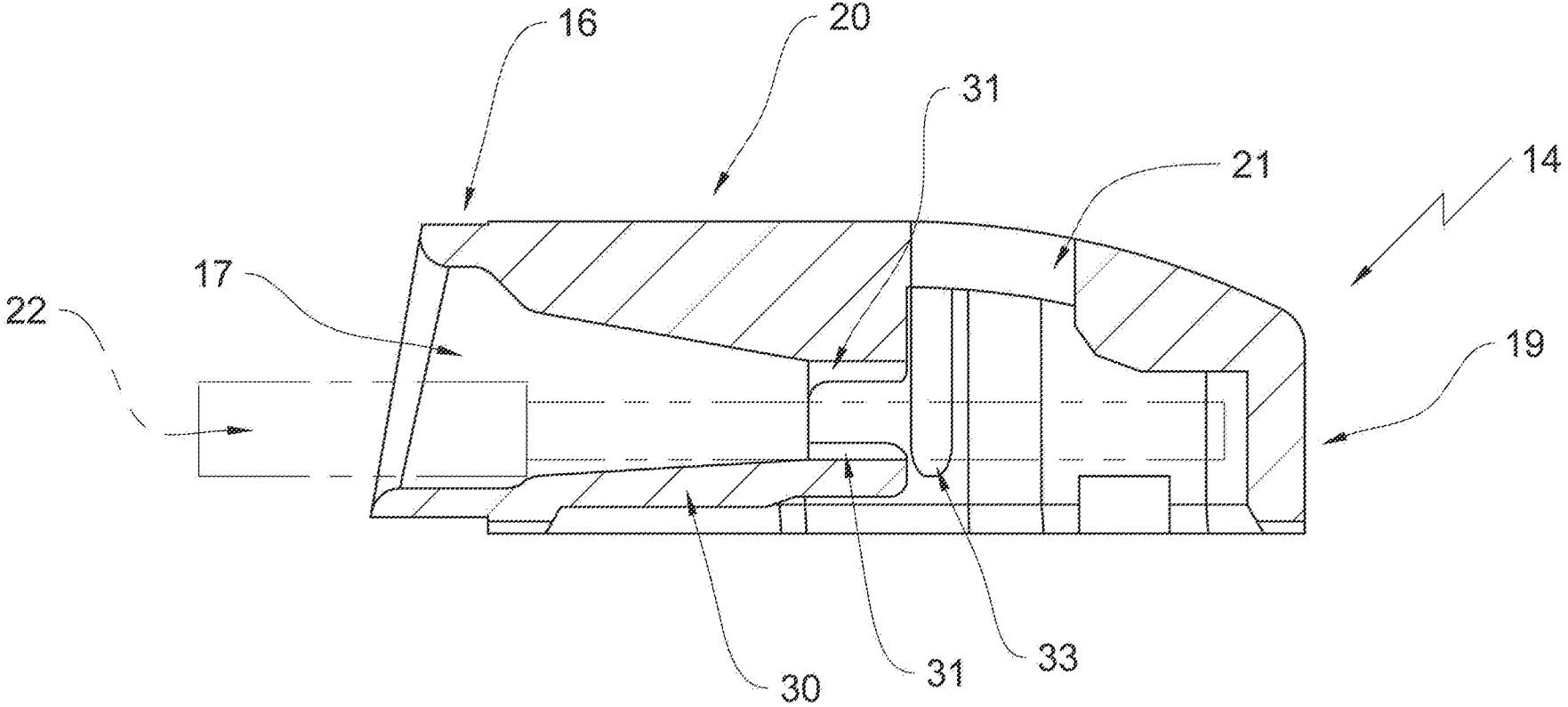
FIG. 7 illustrates the sectional view according to FIG. 6 without connection conductor and contact frame.

The configuration of the insulation material housing 14 illustrated in particular various sectional views in FIGS. 5-7 is essential for the invention. FIGS. 5 and 6 also illustrate the contact frame 13 in addition to the insulation material housing 14. FIG. 5 additionally shows the terminal conductor 22.

As illustrated in FIGS. 5-7 the insulation material housing 14 forms a conductor insertion channel 30 in its interior adjoining the conductor insertion opening 17 and the collar 16 enveloping the conductor insertion opening. This conductor insertion channel is approximately tubular, this means enveloped by the insulation material on all sides along its longitudinal channel axis wherein the conductor insertion channel includes a conductor exit opening 31 at an end that is distal from the conductor insertion opening 17. Thus, the conductor insertion channel 30 tapers approximately funnel shaped in the conductor insertion direction x and thus guides the insulation stripped conductor end in a controlled manner to the clamping device 29 formed by the clamping springs 27.

The conductor insertion channel 30 is arranged in a portion between the sidewalls 25 of the contact frame 13. The conductor exit opening 31 is thus arranged approximately in a root portion of the clamping springs 27 that extend from the sidewalls 25 in the conductor insertion direction x.

Since the clamping springs 27 are oriented towards each other and form an approximately wedge-shaped space between each other (cf. FIGS. 2-4) no channel guide that is enclosed on all sides can be implemented in the portion between the clamping springs 27. In order to provide guidance that is reliable and centered at least in the vertical direction the insulation material housing 14 forms a guide tongue on the channel floor and on the channel ceiling adjacent to the conductor exit opening 31. Both guide tongues 32 have a contour that is conically tapered in the conductor insertion direction x. Horizontal guidance is provided by the clamping springs 27 in the portion of the guide tongues 32.

FIGS. 5-7 illustrate another essential advantage of the terminal clamp according to the invention in addition to optimal guidance of the terminal conductor 22. In terminal clamps without the conductor insertion channel 30 according to the invention portions of the contact frame 13 typically at least the contact floor 23 behind the conductor insertion opening 17 are exposed. Therefore an insulation stripped end of the terminal conductor contacts metal portions of the contact frame 13 long before reaching the clamping device during insertion so that an advance contact is established. This can cause undesirable erroneous contacting when mounting the connection conductor 22 under a voltage or when there is a residual charge in electronic components that are mounted on the circuit board. However, it is also possible that this advance contacting during mounting of the connection conductor 22 with a test voltage applied indicates reliable electrical contacting that is not provided due to a lacking seating of the insulation stripped connection conductor end in the clamping device.

FIGS. 5 and 6 furthermore show that the guide tongues 32 also help to prevent this advance contacting. Last not least FIGS. 5 and 6 also indicate that the spreading appendices 28 of the clamping springs 27 are arranged in a portion of the cut out 21 of the cover wall 20 of the insulation material housing 14. The cut out 21 of the insulation material housing 14 renders the spreading appendices 28 or the clamping device 27 accessible for a spreading tool. This spreading tool can open the clamping device either for no resistance mounting of the connection conductor 22 or for dismounting the connection conductor.

FIG. 7 illustrates another structure in addition to the already described structures of the insulation material housing 14. Thus, the side walls 18 of the insulation material housing 14 include at least one respective contact bar 33 at inner surfaces of the side walls wherein the contact bar is arranged in a portion of the clamping springs 27 of the contact frame 13. The contact bar 33 is configured to limit the deflection or opening movement of each clamping spring 27 in a direction towards a respective side wall 18. This way it can be assured that the clamping springs 27 cannot be opened wider than a width of the contact floor when the clamping device is opened. This avoids that the connection conductor moves into a gap between the contact base 23 and the clamping spring 27 with its insulation stripped end which prevents a closing of the clamping device 29.

Thus, the invention illustrates advantageously how a reliable mounting of a connection conductor 22 that prevents advance contacting can be implemented in a terminal clamp 10 by an insulation material conductor insertion channel 30 which is formed by the insulation material housing 14 itself.

The invention furthermore shows how conductor guidance as well as preventing an advance contact can be improved by guide tongues 31 that are arranged proximal to the contact floor and remote from the contact floor.

Last not least the invention advantageously provides a limitation of a deflection travel of the clamping springs 27 in order to secure a reliable function of the clamping device 29 of the terminal clamp 10.

REFERENCE NUMBERALS AND DESIGNATIONS

10 terminal clamp
11 circuit board
12 contact base
13 contact frame
14 insulation material housing
15 contact field
16 collar
17 conductor insertion opening
18 side wall
19 rear wall
20 cover wall
21 cut out
22 connection conductor
23 contact base
24 bridge section
25 contact side wall
26 receiving cavity
27 clamping spring
28 spreading appendix
29 clamping device
30 conductor insertion channel
31 conductor exit opening
32 guide tongue
33 stop bar
x conductor insertion direction

What is claimed is:

1. A terminal clamp, comprising:

a contact frame that forms a clamping device configured to fix and electrically contact a connection conductor, wherein the clamping device is formed by two clamping springs that are preloaded relative to each other;

a conductor insertion channel that feeds the connection conductor to the clamping device; and an insulation material housing that supports the contact frame and forms a conductor insertion opening that is arranged upstream of the conductor insertion channel in a conductor insertion direction, wherein the conductor insertion channel is formed by the insulation material housing, wherein the conductor insertion channel is formed as a tube made from the insulation material, wherein the tube extends from the conductor insertion opening to the clamping device, wherein the conductor insertion channel tapers in a funnel shape from the conductor insertion opening in the conductor insertion direction towards the clamping device, wherein the contact frame forms two contact side walls that are arranged at a contact floor and that receive the conductor insertion channel formed by the insulation material housing between each other, wherein the conductor insertion channel forms a first guide tongue that is monolithically formed with the insulation material housing and proximal to the contact floor and a second guide tongue that is distal from the contact floor at an end of the conductor insertion channel that is distal from the conductor insertion opening, wherein the two clamping springs extend respectively in the conductor insertion direction from each side wall of the insulation material housing, wherein free ends of the two clamping springs oriented towards each other form the clamping device, wherein the first guide tongue that is monolithically formed with the insulation material housing and proximal to the contact floor includes a free end that extends in the conductor insertion direction between the two clamping springs and rests on the contact frame, wherein the first guide tongue and the second guide tongue extend longitudinally in the conductor insertion direction from the funnel shape of the conductor insertion channel to a midsection of the two clamping springs so that end so that end portions of the first guide tongue and the second guide tongue are arranged between the clamping springs in a direction perpendicular to the longitudinal conductor insertion direction and into a portion of the conductor insertion channel that has a constant height in the conductor insertion direction and that is arranged between the two clamping springs, wherein the constant height of the conductor insertion channel is measured between the first guide tongue and the second guide tongue perpendicular to the conductor insertion direction, wherein the conductor insertion direction is parallel with an axis of the portion of the conductor insertion channel that has the constant height, wherein the portion of the conductor insertion channel that has the constant height is arranged upstream from the free ends of the contact springs in the conductor insertion direction, wherein an inward oriented contour of the first guide tongue and an inward oriented contour of the second guide tongue each taper relative to the axis from the funnel shape of the conductor insertion channel in the conductor insertion direction directly to the portion of the conductor insertion channel that has the constant height, and wherein the inward oriented contour of the first guide tongue and the inward oriented contour of the second guide tongue do not taper in the conductor insertion direction in the portion of the conductor insertion channel that has the constant height.

2. The terminal clamp according to claim 1, wherein the inward oriented contour of the first guide tongue and the inward oriented contour of the second guide tongue taper over an identical axial distance at a constant respective taper angle from the funnel shape of the conductor insertion channel in the conductor insertion direction directly to the portion of the conductor insertion channel that has the constant height.

3. The terminal clamp according to claim 1, wherein a surface of the first guide tongue that is monolithically formed with the insulation material housing and oriented towards the contact floor tapers in the conductor insertion direction towards the free end that extends in the conductor insertion direction between the two clamping springs.

* * * * *